US006972686B2

(12) United States Patent
Schroeder

(10) Patent No.: US 6,972,686 B2
(45) Date of Patent: Dec. 6, 2005

(54) RADIATED FIELD DETECTOR

(75) Inventor: Otto Schroeder, Mineola, NY (US)

(73) Assignee: Sid Harvey Industries Inc., Valley Stream, NY (US)

( * ) Notice: Subject to any disclaimer, the term of this patent is extended or adjusted under 35 U.S.C. 154(b) by 15 days.

(21) Appl. No.: 10/350,609

(22) Filed: Jan. 24, 2003

(65) Prior Publication Data

US 2004/0145488 A1 Jul. 29, 2004

(51) Int. Cl.[7] ..... G08B 17/12; G08B 21/00; G01R 33/02; G01R 29/08

(52) U.S. Cl. ..... 340/646; 340/600; 340/692; 340/693.9; 324/72; 324/95; 324/109; 324/149; 324/633; 324/652; 324/655; 361/38

(58) Field of Search ..... 340/635, 646, 340/600, 693.7; 324/726, 258, 72.5, 128, 324/633, 652, 655; 361/38

(56) References Cited

U.S. PATENT DOCUMENTS

| | | | | |
|---|---|---|---|---|
| 3,596,135 | A * | 7/1971 | Stenger et al. | 361/38 |
| 4,392,106 | A * | 7/1983 | Yakovlev et al. | 324/72.5 |
| 4,698,741 | A | 10/1987 | Pacholok | 363/131 |
| 4,800,371 | A * | 1/1989 | Arsi | 340/593 |
| 5,256,960 | A * | 10/1993 | Novini | 324/72 |
| 5,512,823 | A * | 4/1996 | Nepveu | 324/258 |
| 6,445,196 | B1 * | 9/2002 | White | 324/726 |
| 6,577,132 | B2 * | 6/2003 | Bartulos | 324/404 |

* cited by examiner

*Primary Examiner*—Jeffery Hofsass
*Assistant Examiner*—Lam Pham
(74) *Attorney, Agent, or Firm*—Dilworth & Barrese LLP

(57) ABSTRACT

A testing device is operative to sense or monitor a radiated field emitted by an igniter for heating equipment such as an oil burner and to indicate the detection corresponding to a normal operating state of the igniter.

8 Claims, 3 Drawing Sheets

RADIATED FIELD DETECTOR

BACKGROUND OF THE INVENTION

1. Field of the Invention

The present invention relates to a device operative to sense or monitor a radiated field. In particular, the invention relates to a contactless device configured to sense an operating condition of equipment, which is capable of generating a radiated field and, primarily, associated with oil and gas heating equipment, and to a method of detecting the same.

2. Background of the Invention

Following the inevitable technological trend, heating equipment steadily edges toward high-level electronics requiring sophisticated testing devices. In a situation familiar to millions of homeowners, when on a cold night, the boiler suddenly stops and the coziness of the house disappears with each passing minute, the only hope is the coming of the repairman. It would be nice if the repairman were clairvoyant and could immediately identify the cause of the problem. The odds, however, are that even a highly experienced repairman would spend quite a length of time investigating part after part of complex fuel-conveying, electronic control and ignition systems before discovering the cause of the problem.

A burner typically consists of a fan that blows air past a nozzle spraying oil under pressure. The oil-air mixture is ignited by placing arcing electrodes slightly upstream of the fuel spray and using the high velocity air from the fan to blow the hot gas from the arc into the oil spray. The heat from the gas causes the combustion of the oil-air mixture. In these burners, the voltage needed to provide the appropriate arc is typically between five to ten thousand volts or more. In first-generation oil burners, such high voltages were normally produced with a low frequency, step-up transformer connected to a standard 60 Hz power line. However, due to the core requirements of power transformers designed to operate at such low frequencies, these transformers were large, heavy, and expensive.

Additionally, discharge ignition gas burner systems used in furnaces also require a high voltage for operation. These devices have used expensive, heavy, low frequency step-up transformers to provide the high voltage from a 60 Hz power line. Similarly, natural gas and liquefied propane (LP), hereinafter both referred to as "gas," are commonly ignited in gas appliances either by a standing pilot flame, an electric spark, or a hot-surface igniter. It is possible to operate transformers for oil burners at low frequencies, such as 60 Hz.

Much smaller, lighter, and less expensive transformers may be used to realize the power requirements if powered by a higher operating frequency. Thus, solid-state power suppliers have been developed to provide this higher operating frequency, as exemplified by U.S. Pat. No. 4,698,741.

FIG. 1 shows an oil igniter circuit commonly available in the prior art. The circuit comprises a source of alternating current, a resonant tank circuit 22, a solid state transformer 28 comprising primary winding 14 and secondary windings 27, and a switching transistor 20. In a circuit of this type, line voltage from a commonly available AC wall outlet is half-wave rectified by diode 10 and may then be slightly filtered by capacitor 12. A parallel resonant tank circuit 22, composed of the inductance from one transformer primary winding 14 and capacitor 18, resonates at approximately 30 kilohertz. When transistor 20 begins to conduct, the inductance at transformer winding 14 is magnetically coupled to primary transformer winding 16 such that as a voltage appears across transformer winding 14, an in-phase voltage appears across transformer winding 16. This results in more current feed into the base of transistor 20, so the process is regenerative. Thus, a power oscillator is realized, comprised of a resonant tank circuit 22, feedback transformer winding 16, transistor 20, and resistors 24 and 26. Secondary transformer windings 27 are generally wound with a larger number of turns than primary windings 14 and 16. A high voltage ranging between 14 KV and 17 KV is thereby obtained from transformer windings 27 since windings 27 are magnetically coupled to transformer windings 14 and 16. The solid state transformer can operate at frequencies less than around 10 kilohertz, which are generally audible and annoying to their owners, or above this low threshold and desirably above 25 kilohertz, which are less audible and, thus, are generally preferred.

Devices for testing the operation of the solid-state transformer/igniter are known. For example, as shown in FIG. 2, a portable hand-held device 30 can accomplish the testing of the operating condition of a solid-state igniter by coupling high voltage spheres 32 with the high voltage contacts of any brand of transformer or igniter. Acting as a regular voltmeter, the device 30 indicates the proper operating condition of the igniter when the LED 34 lights. If the LED 34 fails to light in 3 seconds, the transformed should be replaced.

A few disadvantages may be associated with the hand-held device 30. First, this device may not be safe. As mentioned before, the solid-state igniter generates up to about 17 KV; exposure to such a high voltage can be fatal for the user. To somewhat minimize the risk associated with the use of the tester 30, a specifically designated end region 42 of the housing, which is spaced at a maximum distance from the voltage spheres 32 located on the opposite end of the housing, serves as a device holder. However, the only insulator protecting the user from so high a voltage (17 KV) is the housing made from a thin plastic that may not be nearly enough to ensure the safety of the user.

Second, the testing cannot be performed while the burner is functioning, and, thus, the testing of the solid-state igniter can be conducted only after the long and tedious process of connecting manipulations. Particularly, the power to the entire burner is initially shut off, and a mounting plate 38 is unscrewed and flipped over to expose high output connectors 40. Only after the user has brought the spheres 32 in contact with the connectors 40, the power is turned on, and the test is conducted. If the igniter is good, the entire operation is repeated to set the system in its initial position, otherwise, the user cannot perform further testing of other parts of the system. Moreover, some oil and gas-replacement burners are equipped with plugged in solid-state igniters that simply cannot be opened up and tested. Such igniters can be tested only in an operating condition. Accordingly, a further disadvantage of the hand-held device 30 is that a diagnostic test of operating conditions of solid-state igniters, capable of being tested by the device 30, requires additional efforts on part of the technician and is, thus, time-consuming.

Safety, reliability and structural simplicity are some of the critical requirements applied to any testing or monitoring equipment. Accordingly, it is desirable to provide a device configured to detect an electromagnetic field radiated by high voltage solid-state devices, such as an igniter, and a new method of testing associated with the novel device and directed to identifying the operating condition of such devices.

SUMMARY OF THE INVENTION

In view of the foregoing background, the present invention advantageously provides a method and device for remotely sensing a radiated field to monitor a solid-state device in general, and in particular, an operating condition of a solid-state igniter. The present invention also provides a method and apparatus for reducing inspection costs and also creates new monitoring capabilities not possible or not available for various types of systems. The present invention further advantageously increases reliability, readiness, flexibility, and safety and greatly reduces maintenance time, labor, and cost for monitoring various types of systems. For example, the apparatus advantageously can readily be expanded for additional types of equipment, which may be desired on various selected applications.

More particularly, the present invention provides a method of monitoring an operating state or condition of electronic device, such a solid-state igniter, by remotely sensing a radiated field and, further, by indicating the sensed radiated field.

In accordance with another aspect of the invention, a device, operating in accordance with the inventive method, is capable of sensing low, middle and high frequency radiated fields and of generating a signal in response to the detection of the fields. The device is contactless and, thus, is operative to remotely monitor or sense the radiated field.

Therefore, the method and apparatus advantageously provide a smart wireless device configured to monitor or sense and indicate a radiated field of electronic device, such as a solid-state transformer/igniter, in a safe manner.

It is, therefore, an object of this invention to provide a method for remotely detecting of operating state of solid-state electronic device, such as an igniter;

A further object of the invention is to provide a contactless device operative to monitor or sense a radiated field generated by an electronic device, such as a solid-state igniter.

BRIEF DESCRIPTION OF THE DRAWINGS

Other objects of the present invention will become apparent upon reading the following specification and referring to the accompanying drawings, which form a material part of this disclosure.

DETAILED DESCRIPTION

Figure 1:
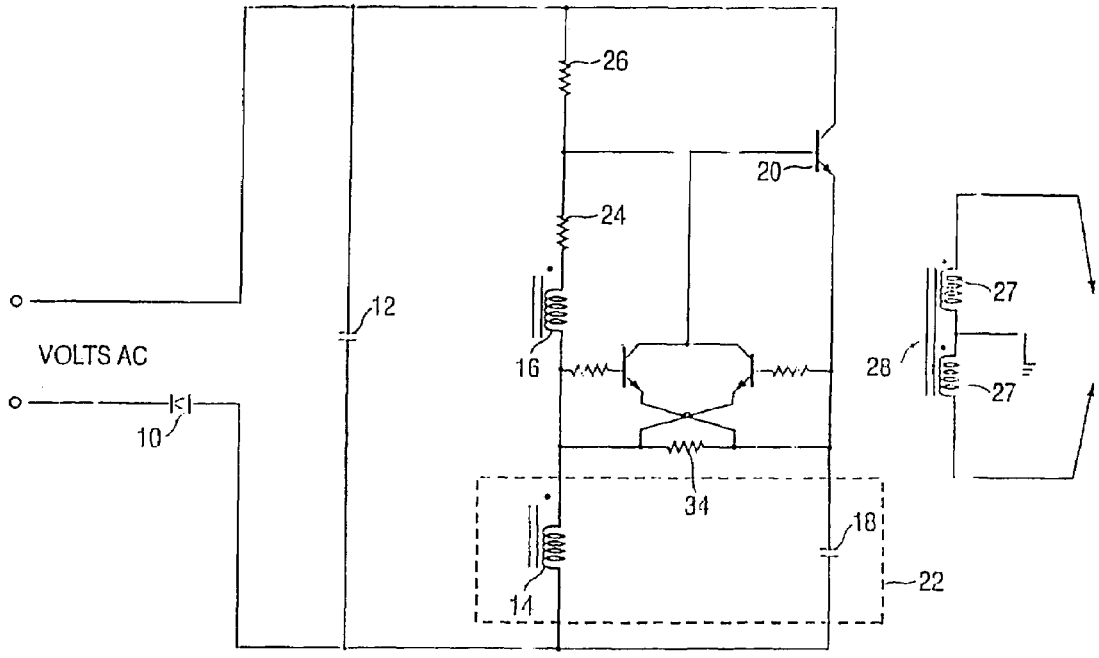
FIG. 1 (PRIOR ART)
FIG. 1 is an example of the circuitry of a prior art solid-state igniter.
Figure 2:
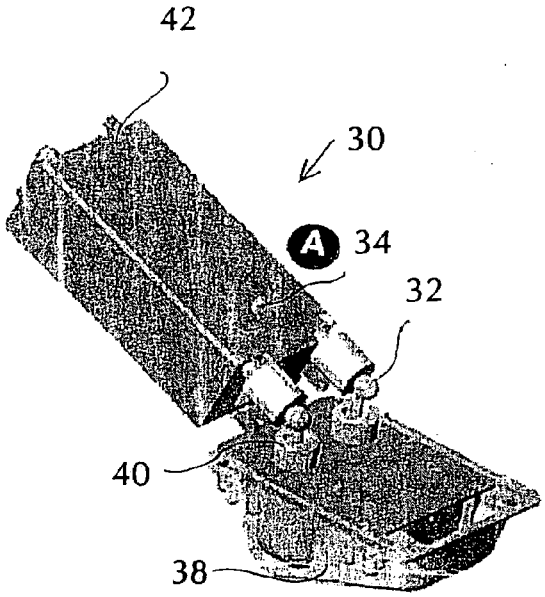
FIG. 2 (PRIOR ART)
FIG. 2 is an igniter tester configured in accordance with the known prior art.
Figure 4:
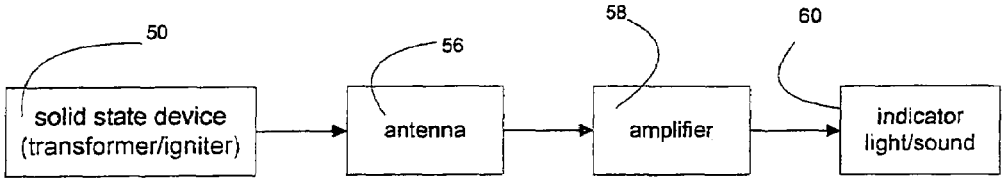
FIG. 4 is a block diagram of the inventive device.
Figure 3:
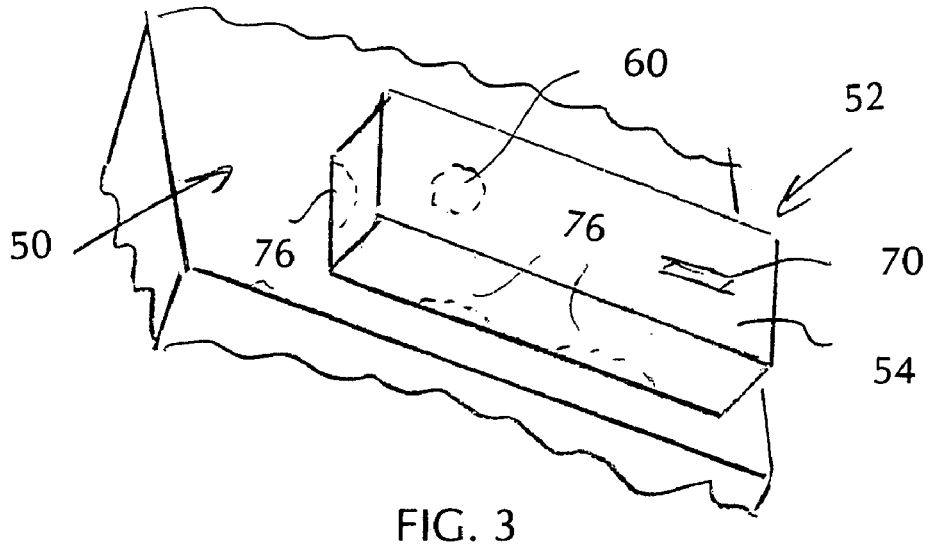
FIG. 3 is a view of a radiated field detector configured in accordance with the invention to monitor an operating state of solid-state devices.

Referring to FIGS. 3 and 4, the inventive radiated field detector 52 is configured to detect an electromagnetic field generated by a solid-state device 50, such as an electronic igniter, which is used with either an intermittent pilot flame or which ignites a burner directly with a spark. The igniter 50 would not function unless the transformer functions and generates sufficient voltage.

The radiated field detector device 52 includes a housing 54 typically made from light material, which may include plastic or metal, and enclosing detecting circuit that may be implemented in a variety of ways. Principally, as better illustrated in FIG. 4, the detector device 52 has a radiated field pick-up means, such as an antenna 56, generating an antenna current in response to the RF radiation that is emitted by the operating transformer or upon generating a spark and is incident on the antenna 56. The antenna current is amplified by an amplifier 58 to a desired output signal sufficient to provide voltage differential across an indicator means 60, which can visually signal the presence of the sensed radiated field and, thus, the operating state of the igniter 50. Additionally, an audio circuit can be added to produce an audio signal along with the visual signal.

In use, the detector device 52 can be placed either directly on the solid-state device 50, as shown in FIG. 3, or a support located in the vicinity of the solid-state device 50 at a distance up to several inches, and left untouched by the operator. Accordingly, the risk of exposing the operator to high voltage is completely eliminated. If the igniter functions properly—either a spark is generated or a transformer functions properly—a flashing light signal, lasting for a few seconds, and/or an audio signal will attract the operator/repairman's attention. If the signal is not generated, after the operator inspects and determines that the electrical connections are sound, the igniter is automatically identified as the cause of the problem, associated either with the capacitor or the transformer, and should be replaced.

Figure 5:
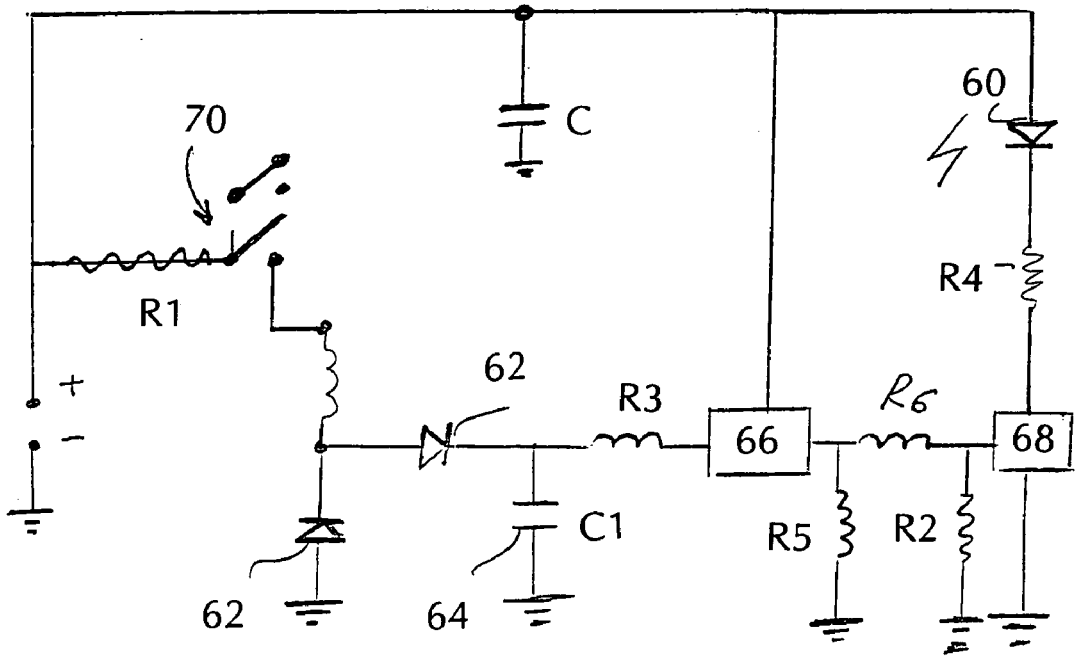
FIG. 5 is an embodiment of circuitry configured in accordance with the inventive concept of the present invention.

An example of a light-indication high-impedance circuitry configured in accordance with the invention to sense or monitor the radiated field is illustrated in FIG. 5. In operation, the antenna 56 is inductively coupled to the transformer of the solid-state device 50, typically radiating electromagnetic energy in a high-frequency range, to output AC antenna current, which is typically small. After rectification performed by a pair of diodes 62 shunting the negative portion of the sinusoid waveform to ground, the positive portion will charge up a capacitor ($C_1$) 64 to 8V, which acts as a power supply source for a load including a transistor 66 and a resistor R5. Since the antenna current is low, to activate the transistor 66, it is preferred to use a Darlington set-up in which two regular transistors are ganged. The use of the Darlington set-up for the purposes of proper functioning of the circuitry is not exclusive. For example, a FET can be utilized as well. However, while the Darlington transistor can be activated by as low a power as a 4V source, typically the FET requires a more powerful source.

By properly selecting resistors R6 and R2, the circuitry is able to provide a voltage sufficient to turn on an SCR or thyristor 68 connected in series with the indicator 60, such as an LED. Once a voltage of about 2V is achieved, the thyristor 68 is triggered or closed and, thus, the voltage differential across the indicator 60 is achieved to cause the latter to go on and off for a few-second reporting time period during the bleeding period of the capacitor 64.

In addition, the inventive testing device 52 can operate in a self-test mode. For this purpose, in response to pushing a rocker switch 70 (FIG. 3) connecting a power source, such as a 9 V battery, the LED 60 should blink indicating that the testing device 52 is in a good operating condition. Otherwise, the testing device is to be inspected and, if the battery is not the cause of the problem, replaced. To facilitate mounting of the inventive device 52 either directly on the solid-state transformer/igniter 50 or on any other support located in the vicinity of the igniter 50, the housing 54 of the inventive device 52 can be provided with a mounting means including a plurality of suction cups 76 (FIG. 3) and/or hooks (not shown). To generate a sound signal, a standard sound-generating circuit can be integrally provided within the housing 54 of the testing/monitoring device 52. It is conceived to provide a kit including the inventive testing device along with a variety of mounting means.

Although the inventive device has been disclosed in the high-frequency range context, a skilled worker can easily use the device as a tester of a radiated low frequency field. As such, for example, the device can be a reliable indicator of properly functioning transformer, provided, of course, it is properly positioned. In this case, the antenna would function as a simple pick-up coil. Accordingly, while the invention has been disclosed with respect to preferred embodiments, various changes can be made without departing from the scope of the invention as defined by the appended claims.

What is claimed is:

1. A method of determining an operating state of an igniter for heating equipment including a burner, comprising:

providing a detector for sensing a radiated electromagnetic field adjacent to the igniter;

sensing an electromagnetic field emitted by the igniter during operation of the igniter; and providing an indication of normal operation of the igniter based on the sensed electromagnetic field to an operator.

2. The method of claim 1, wherein the indication of the sensed radiated field is provided by a flashing light signal.

3. The method of claim 2, wherein the flashing light signal lasts for a predetermined period of time after the detection of the normal operation of the igniter.

4. The method of claim 1, wherein the indication of the sensed radiated is provided by a sound signal.

5. A detector for determining an operating state of an igniter for heating equipment including a burner, comprising an insulated housing assembly; an antenna operative to sense a radiated electromagnetic field emitted by the igniter; and an indicator operative to output a signal in response to the sensed radiated field indicative of normal operation of the igniter.

6. The detector of claim 5, wherein the indicator is an LED operable for a predetermined period after the radiated field has been sensed.

7. The detector of claim 5, wherein the housing is provided with a mounting assembly selected from the group consisting of suction cups, hooks and a combination thereof.

8. The detector of claim 6, wherein an antenna generates an induced current during the normal operating state of the igniter, the detector further comprising an amplifier including one of a Darlington transistor or an FET which outputs a signal to trigger a thyristor coupled with the amplifier and the LED.

* * * * *